United States Patent [19]

Neese

[11] 4,163,315

[45] Aug. 7, 1979

[54] METHOD FOR FORMING UNIVERSAL FILM RESISTORS

[75] Inventor: Wayne E. Neese, Hoffman Estates, Ill.

[73] Assignee: GTE Automatic Electric Laboratories Incorporated, Northlake, Ill.

[21] Appl. No.: 906,548

[22] Filed: May 17, 1978

[51] Int. Cl.[2] ..... H01C 7/00

[52] U.S. Cl. ..... 29/620

[58] Field of Search ..... 29/610 R, 620; 338/195, 338/308, 314

[56] References Cited

U.S. PATENT DOCUMENTS

| | | | |
|---|---|---|---|
| 3,284,878 | 11/1966 | Best | 29/620 |
| 3,573,703 | 4/1971 | Burks | 29/620 |
| 3,594,679 | 7/1971 | Seay | 29/620 |
| 3,947,801 | 3/1976 | Bube | 338/308 |

*Primary Examiner*—Leon Gilden
*Assistant Examiner*—Gene P. Crosby

[57] ABSTRACT

A method for forming a film resistor for hybrid circuits trimmable from 0 ohms to infinite resistance, whereby resistive material is deposited over previously applied conductive material. One edge of the resistor material is flush with one edge of the conductor path and the resistor material extends beyond the opposite side of the conductor path. The resistor is trimmed to value by a laser or mechanically abrading a slot in its center perpendicular to the conductor by simultaneously removing a portion of both conductor and resistive material.

5 Claims, 3 Drawing Figures

METHOD FOR FORMING UNIVERSAL FILM RESISTORS

BACKGROUND OF THE INVENTION

1. Field of the Invention

This invention relates in general to film resistors and more particularly to a method of forming a universal film resistor for hybrid circuits.

2. Description of the Prior Art

Film resistors are commonly used in hybrid circuits and include thick film resistors which are conventionally formed by screen-printing a resistive material on an insulating substrate and then firing the material, and thin film resistors which are conventionally formed by sputtering or vacuum-depositing a resistive material on an insulating substrate.

In hybrid circuits it is often necessary to adjust the resistance of the film resistors in the circuit. To increase the resistance of a film resistor, the resistor is "trimmed" by forming a slot across the electrical current path in the resistor to make the effective width of the resistor smaller and thereby increased resistance. The channel may be formed by mechanical abrasion, chemical etching, or laser vaporization of the resistor material.

At present, film resistors for hybrid circuits require resistive material of different ranges and values. The final resistance value depends on the aspect ratio of the resistor and the sheet resistivity of the resistive material. When a wide range of values is required in the manufacture of a hybrid circuit the deposition of resistor material must be repeated for each different range of value of resistance. Such resistors are processed to lower values than the circuit calls for and after completion of the manufacturing process are trimmed up in value to the resistance required in the circuit.

This method has been found to be costly and time consuming in manufacturing hybrid film circuits because of the two or more different resistor compositions required.

Accordingly, it is the object of the present invention to provide a method of manufacturing a film resistor, employing one resistor composition that can be trimmed to any value from 0 ohms to an infinite resistance for a film hybrid circuit.

SUMMARY OF THE INVENTION

In accordance with this invention, the method in its broader aspect comprises applying an uninterrupted conductor on a substrate and depositing a resistive material over the previously applied conductor with one edge of the resistive material flush with one edge of the conductor path and the resistive material extending beyond the opposite side of the conductor path. The resistive material is then trimmed by simultaneously removing a portion of both the conductor and resistive material by laser or mechanically abrading a slot in its center perpendicular to the conductor. As the trimmed slot progresses into the resistor and conductor the resistance slowly changes. As the slot progresses passed the conductor the resistance rises sharply to a value that theoretically could approach infinity.

BRIEF DESCRIPTION OF THE DRAWINGS

A better understanding of the invention may be had from a consideration of the following detailed description taken in conjunction with the accompanying drawings in which.

DESCRIPTION OF THE PREFERRED EMBODIMENT

Figure 1:
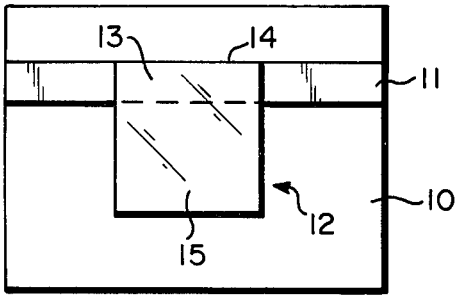
FIG. 1 is a plan view of a dielectric substrate with a resistive material applied on a previously deposited conductor.

Referring now to the accompanying drawings of the present invention, FIG. 1 illustrates a dielectric substrate 10, having applied thereon an uninterrupted conductor path 11, such as conductive metal films of gold, copper, and the like. A pad of resistive material 12, such as carbon, metal, or cermet film, is deposited with a portion 13 applied directly on the conductor path 11, including an edge 14 flush with an edge of the conductor and a portion 15, applied on the substrate extending beyond an opposite edge of the conductor path 11.

It should be noted that whenever a resistive material contacts a conductor material the resistor material becomes contaminated with the conductor material causing a decrease in resistivity around the contact area. The decrease in resistivity is greatest at the point of contact and becomes less contaminating as the resistor material increases in distance from the conductor.

Figure 2:
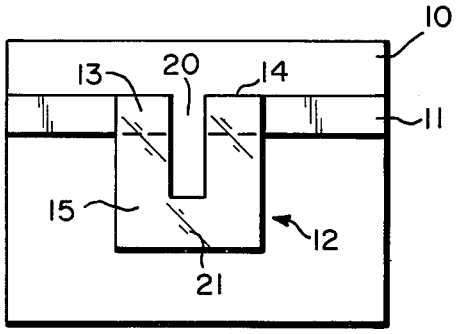
FIG. 2 is a plan view, illustrating one embodiment, formed in accordance with the method of this invention.

Referring now to FIG. 2, a slot 20 is formed by simultaneously vaporizing material from the combined conductor and resistive material portion 13 with a laser beam, or by directing a stream of sandblasting particles, thereby forming the slot by mechanical abrasion. The slot 20 is started at edge 14 of the resistive material and is extended substantially perpendicular to the conductor path 11. As the trimmed slot progresses into the resistor and conductor portion 13, the resistance value changes slowly. This small change in resistance value, is attributed to the contamination of resistive material by conductor material, and is used to advantage where only minor changes in resistance trim are required. As the slot progresses severing the conductor path 11 and moving into the uncantaminated resistive material 15 the resistance rises sharply to a value that theoretically could approach infinity. The slot 20 is continued until an area 21 which defines a desired current path across the resistive material 12, and trims the resistor for large resistive values.

Figure 3:
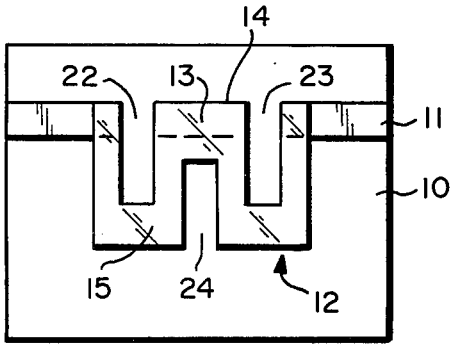
FIG. 3 is a plan view, illustrating another embodiment, of a film resistor formed in accordance with the method of this invention.

For extremely large changes in resistance values, three slots may be cut into the resistor as shown on FIG. 3. Slots 22, 23 are cut from the conductor side at points approximately one-quarter the width of the resistor material from the left and right sides respectively and a center slot 24 is cut into portion 15 of the resistor pad 12. Center slot 24 would trim the resistor to value.

This method of forming a hybrid film resistor eliminates the additional steps in processing of film circuits that are necessary when a hybrid circuit requires a wide range of resistor values.

The present invention has been described with reference to a specific embodiment thereof, for the purpose of illustrating the manner in which the invention may be used to advantage, it will be appreciated by those skilled in the art that the invention is not limited thereto. Accordingly, any and all modifications, variations or equivalent arrangements which may occur to those skilled in the art should be considered to be within the scope of the invention.

I claim:

1. The method of forming an electrical resistor comprising:

applying an uninterrupted conductor on a dielectric substrate;

depositing a resistive material, including a first end applied on said uninterrupted conductor and a second end terminating away from said conductor;

simultaneously removing at least one portion of both said conductor and said resistive material, starting at said resistive material first end, severing said conductor, and terminating in an area of said resistive material second end;

thereby, increasing the resistance of said resistor.

2. A method according to claim 1 wherein: said uninterrupted conductor includes first and second edges, and said resistive material first end is deposited flush with said first edge of said uninterrupted conductor and said resistive material second end terminates away from said second edge of said conductor.

3. A method according to claim 2 wherein: at least one portion of both said conductor and said resistive material is simultaneously removed by elimination means, forming a slot perpendicular to said conductor, starting at said conductor first edge and terminating in an area of said resistive material second end away from said conductor second edge.

4. A method according to claim 3 wherein: said elimination means includes directing a sandblasting stream to form said channel.

5. A method according to claim 3 wherein: said elimination means includes directing a laser beam to form said channel.

* * * * *